United States Patent [19]

Swanson

[11] 4,344,059

[45] Aug. 10, 1982

[54] ARCING ROD CATCHER FOR HIGH VOLTAGE FUSE

[75] Inventor: Roy T. Swanson, North Riverside, Ill.

[73] Assignee: S&C Electric Company, Chicago, Ill.

[21] Appl. No.: 741,027

[22] Filed: Nov. 11, 1976

[51] Int. Cl.[3] ..... H01H 71/20

[52] U.S. Cl. ..... 337/174; 337/178; 337/248

[58] Field of Search ..... 337/173, 174, 178, 180, 337/181, 186, 203, 219, 248–250, 275, 277, 282, 407–409

[56] References Cited

U.S. PATENT DOCUMENTS 3,265,838 8/1966 Ackermann ..... 337/277 X
3,500,279 3/1970 Walaspina ..... 337/409

FOREIGN PATENT DOCUMENTS 873440 7/1961 United Kingdom ..... 337/277

*Primary Examiner*—George Harris
*Attorney, Agent, or Firm*—John D. Kaufmann

[57] ABSTRACT

Disclosed is an arcing rod catcher for a high voltage fuse which engages the arcing rod when the arcing rod moves during fuse operation so that the arcing rod will not bounce back or reverse directions during and after fuse operation. Since the arcing rod movement is utilized to actuate a fuse latch assembly to release the fuse from an upper mounting when it operates, it is necessary for the arcing rod to move to the operating position and remain in that position to permanently indicate that the fuse has operated and to prevent the possibility that a blown fuse will be re-latched into a closed position. The disclosed invention utilizes engaging fingers which allow the arcing rod to pass in one direction but prevent the arcing rod from returning in the opposite direction when the fuse operates.

3 Claims, 6 Drawing Figures

FIG. 5
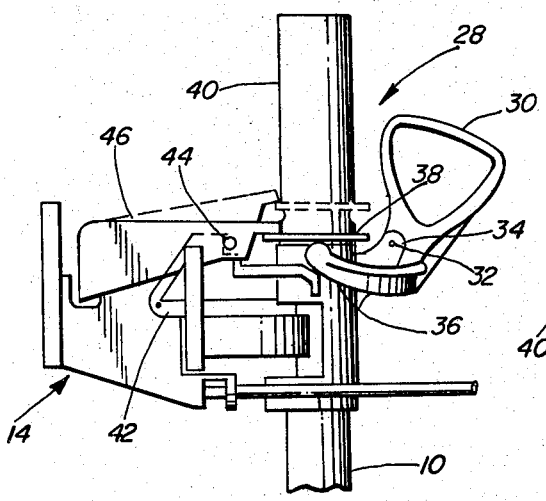
FIG. 6
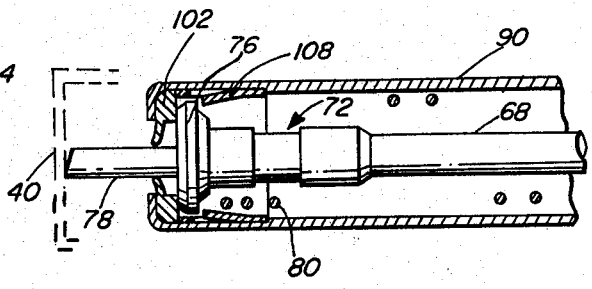
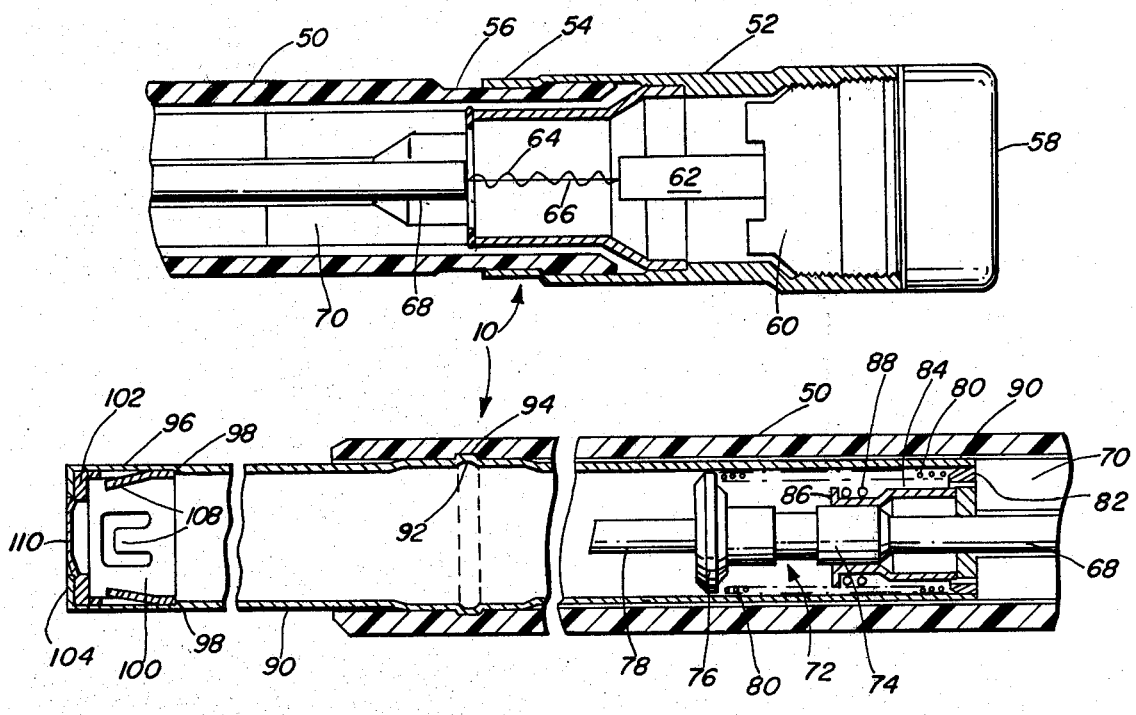
FIG. 2

ARCING ROD CATCHER FOR HIGH VOLTAGE FUSE

BACKGROUND OF THE INVENTION

1. Field of the Invention

The present invention relates to high voltage fuses, and more particularly, to means to assure that a fuse cannot be re-latched into a fuse mounting after fuse operation.

2. Description of the Prior Art

High voltage expulsion fuses of the dropout type are well known in the art as exemplified by U.S. Pat. No. 3,267,235—Barta. Such high voltage fuses are typically mounted between two mounting terminals that are adapted to allow the fuse to be released from one mounting when the fuse operates so that the fuse will pivot away from one terminal and provide a visual indication of fuse operation.

This dropout function is achieved by a spring biased arcing rod which is released when a fusible element at one end melts so that the arcing rod moves very rapidly under the urging of the spring until the other end of the arcing rod pierces a seal at the end of the fuse and engages a fuse release assembly mounted on the end of the fuse causing the fuse to be released from the mounting. However, since the fuse typically pivots free of the top terminal because of the force of gravity, it is necessary for the arcing rod to engage the fuse release assembly for a predetermined period of time to allow the fuse sufficient time to move under the forces of gravity so that the fuse release assembly does not re-engage the mounting terminal before the fuse drops out. In addition, it is desirable for the end of the arcing rod to remain extending out of the fuse so that the operated fuse cannot inadvertently be re-latched into the closed position, and to indicate that the fuse has operated.

Accordingly, it has been discovered that it would be a desirable advance in the art to provide a means for engaging the rod when it moves to the end of the fuse tube to prevent the arcing rod from bouncing or falling away from the end of the tube.

BRIEF DESCRIPTION OF THE INVENTION

The present invention is for use in a high voltage fuse of the type having an arcing rod that moves under the urging of a spring to the end of a metallic conducting tube mounted on the end of the fuse when a fusible element in the fuse melts so that an end of the arcing rod engages a fuse release assembly to cause the fuse to disengage a fuse mounting. The present invention is an improvement comprising means for engaging the arcing rod when it moves to the end of the metallic tube to prevent the arcing rod from moving backward from the end of the tube during or following operation of the fuse.

This improvement comprises a cylindrically shaped member having a hollow interior, the member being dimensioned to fit within the end of the metal tube. The cylindrical shaped member has engaging finger means extending into the hollow interior adapted to allow the arcing rod to pass in one direction through the hollow interior but to prevent the rod from passing in the opposite direction.

Thus, it is a principal object of the present invention to provide an improvement for a high voltage fuse which engages a moving arcing rod at the end of the arcing rod's movement to prevent the arcing rod from bouncing or falling back from its full stroke position.

These and other objects, advantages, and features shall hereinafter appear, and for the purposes of illustration, but not for limitation, an exemplary embodiment of the present invention is illustrated in the accompanying drawings.

DESCRIPTION OF THE DRAWINGS

FIG. 2 is a cross-sectional, partially fragmentary view of the fuse illustrated in FIG. 1 showing the present invention mounted therein.

FIG. 5 is a side, partially fragmentary view of the upper end of the fuse illustrated in FIG. 1 showing operation of the fuse release mechanism.

FIG. 6 is a cross-sectional, partially fragmentary view of the end of the fuse after fuse operation showing the operation of the present invention.

DETAILED DESCRIPTION OF THE PREFERRED EMBODIMENT

Figure 1:
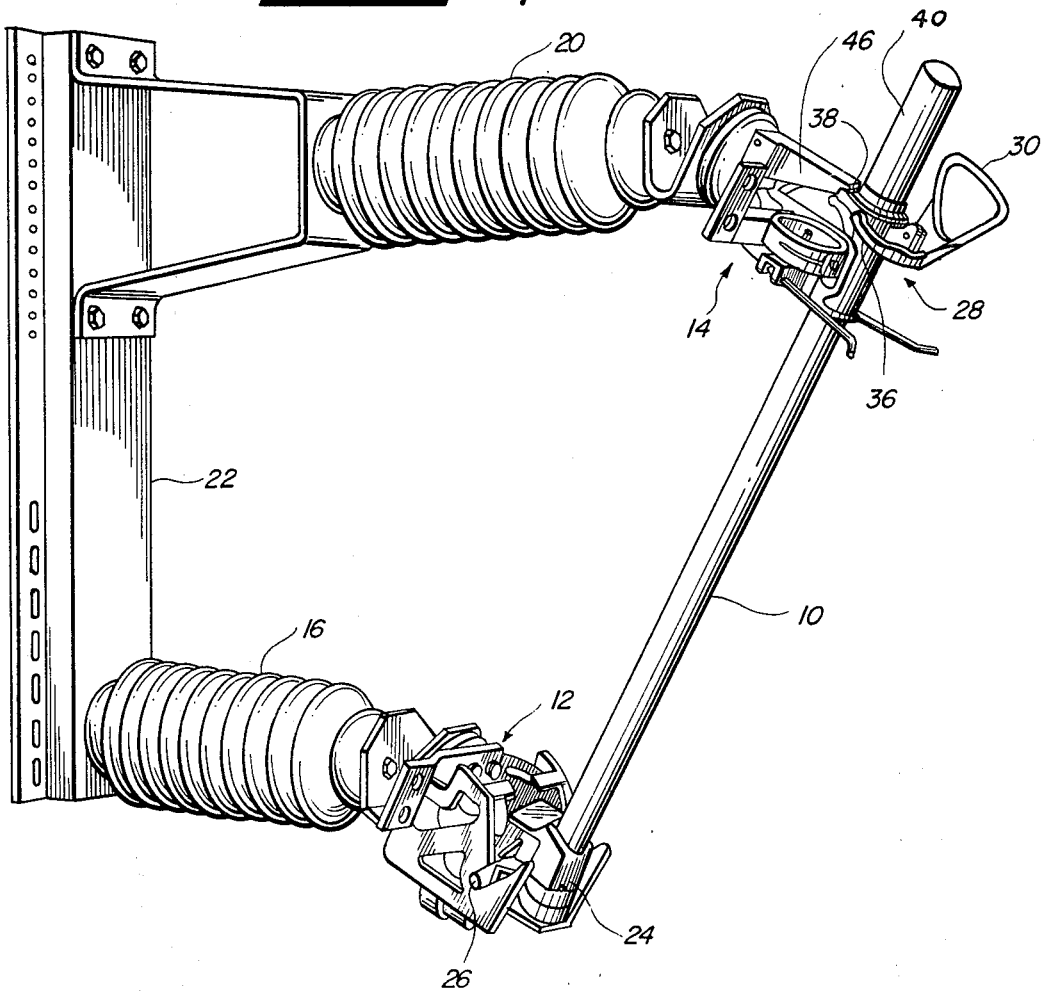
FIG. 1 is a perspective view of a high voltage expulsion fuse of the dropout type in which the present invention may be utilized.

With reference to FIG. 1, a fuse 10 of the dropout expulsion type is shown mounted between a lower mounting terminal 12 and an upper mounting terminal 14. Upper and lower mounting terminals 14 and 12 are mounted to insulators 16 and 20 which in turn are mounted to supporting structure 22. Mounted on the end of fuse 10 is a trunnion assembly 24 which includes a pin 26 which rides in a groove in lower mounting terminal 12 to provide a pivotable mounting between the lower mounting terminal 12 and trunnion assembly 24. Mounted at the other end of fuse 10 is a fuse release assembly 28. With particular reference to FIG. 5, fuse release assembly 28 comprises a hook ring 30 pivotably mounted by a pin 32 to a bracket 34. Arms 36 mounted on hook ring 30 engage a radial flange 38 on latch release tube 40. Fuse release assembly 28 also comprises a latch hook 42 which engages a pin 44 on a pivotably mounted latch 46 mounted on upper mounting terminal 14. As can be seen in FIG. 5, when latch hook 30 is pivoted downwardly, arms 36 push latch release tube and radial flange 38 upwardly to the position illustrated in dotted lines in FIG. 5 so that latch 46 is pivoted to the position illustrated in dotted lines and pin 44 disengages latch hook 42. In this position, the fuse can be pivoted out of upper mounting 14 around pin 36 in the groove in the mounting terminal 12. As will be more fully pointed out later, latch release tube 40 can also be moved to release the fuse from the upper mounting by the operation of the fuse.

With reference to FIG. 2, fuse 10 comprises a hollow insulator tube 50 which may be fabricated from any convenient electrically insulating material such as fiberglass, phenolic, or epoxy resin. Mounted at the end of hollow insulator tube 50 is a metallic exhaust ferrule 52 which is attached by compressing an end portion 54 of ferrule 52 into an annular groove 56 around the exterior of the insulator tube 50. Mounted in the threaded end of ferrule 52 is a rain cap assembly 58 which does not form a part of the present invention and may take the form of the rain cap assembly disclosed in co-pending application Ser. No. 741,023 filed Nov. 11, 1976 now U.S. Pat.

No. 4,047,142, and assigned to the same assignee as the present invention. Also mounted on the threaded interior of ferrule 52 is contact bridge 60. Extending from contact bridge 60 is a column shaped element 62 which has attached to the end thereof a fusible element 64 and a strain wire 66. A fusible element 64 may be typically fabricated from silver alloy and strain wire 66 may be fabricated from a nickel-chrome alloy.

The other end of fusible element 64 and strain wire 66 are attached to the end of an arcing rod 68. Arcing rod 68 extends through a hollow opening through a stack of cakes of arc extinguishing material 70 which form a lining on the interior of insulator tube 50.

Mounted on the other end of arcing rod 68 is a contact button assembly 72 which comprises a contact portion 74, a button flange 76, and a striker pin 78. A compression spring 80 is compressed between button flange 76 and an annular flange 82 on the base of stationary contact assembly 84 mounted in the end of a hollow conducting tube 90. Stationary contact assembly 84 comprises a plurality of individual contact fingers 86 that extend from annular flange 82 and are urged toward one another by garter springs 88 so that the contact fingers provide a positive electrical connection with contact portion 74 of contact button assembly 72.

Conducting tube 90 extends partially through and out the end of insulator tube 50. Conducting tube 90 is attached to insulator tube 50 by expanding the tube at point 92 until it engages an annular groove 94 formed on the interior of insulator tube 50 in the manner described in copending application Ser. No. 741,026, filed Nov. 11, 1976 now U.S. Pat. No. 4,075,235, and assigned to the same assignee as the present invention.

The opposite end of conducting tube 90 has a machined interior portion 96 that has a thinner wall than the remainder of conducting tube 90 so that a small annular flange portion 98 is provided. A catcher assembly 100 is positioned within the end of tube 90 against the flange 98. A sealing arrangement 102 is also positioned within the machined portion of tube 90 and the exterior edge 104 of tube 90 is folded over sealing arrangement 102 to lock the sealing arrangement 102 and catcher assembly 100 within the end of tube 90. Sealing arrangement 102 does not form a part of the present invention and is disclosed in co-pending application Ser. No. 741,015, filed Nov. 11, 1976, now U.S. Pat. No. 4,111,381, and assigned to the same assignee as the present invention.

Figure 3:
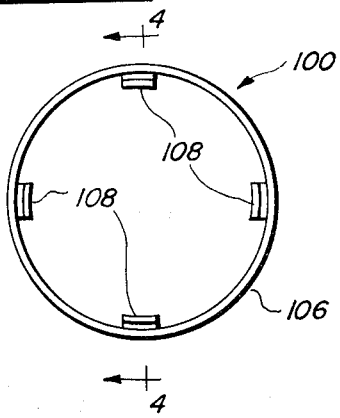
FIG. 3 is a front view of the present invention.
Figure 4:
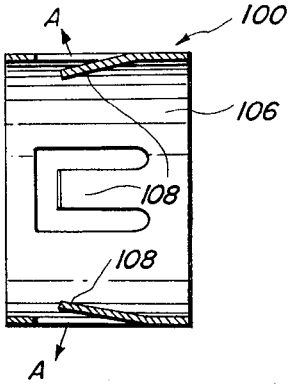
FIG. 4 is a cross-sectional view taken substantially along line 4—4 in FIG. 3.

With reference to FIGS. 3 and 4, catcher assembly 100 comprises a hollow cylindrical portion 106 which is dimensioned to fit within the machined portion 96 of conducting tube 90. Four finger members 108 extend into the hollow interior of cylindrical portion 106 so that the end of finger members 108 are directed toward one end of catcher assembly 100.

Lower mounting terminal 12 is normally connected to one side of a high voltage circuit and mounting terminal 14 is connected to the other side of a high voltage electrical circuit so that the circuit is completed through trunnion assembly 24, ferrule 52, contact bridge 60, element 62, fusible element 64 and strain wire 66, arcing rod 68, contact portion 74, stationary contact 84, conducting tube 90, fuse release assembly 28, and upper mounting terminal 14. When electrical current in excess of the current carrying capabilities of fusible element 64 and strain wire 66 is experienced, fusible element 64 and strain wire 66 melt to allow spring 80 to rapidly accelerate the arcing rod 68 and contact button assembly 72 towards the end of conducting tube 90. An electrical arc is typically drawn between element 62 and the end of arcing rod 68 as it moves through the arc extinguishing material 70, and the arc extinguishing material 70 produces an arc extinguishing gas which extinguishes the arc to cause current interruption. When contact button assembly reaches the end of conducting tube 90, striker pin 78 strikes the thinned portion 110 of sealing arrangement 102 at a relatively high velocity allowing striker pin 78 to pierce the thin portion 110 as illustrated in FIG. 6. The end of striker pin 78 engages the top of latch release tube 40 (illustrated in dotted lines in FIG. 6) causing the latch release tube 40 to move to the position illustrated in dotted lines in FIG. 5 so that the latch 46 disengages the latch hook 42 on fuse release assembly 28. The fuse can then pivot out of the upper mounting terminal 14 under the force of gravity. This provides a clear visual indication to the utility lineman that the fuse has operated so that the lineman knows that the fuse 10 has operated.

As contact button assembly 72 is moved through conducting tube 90 under the urging of spring 88, button flange 76 engages finger members 108 causing finger members 108 to bend outwardly in the direction of arrow A in FIG. 4 so that the button flange can pass beyond finger members 108 to the position illustrated in FIG. 6. Once button flange 76 has passed the ends of finger members 108, finger members 108 spring back to the position illustrated in FIG. 6 so that as button flange 76 strikes the edge of sealing arrangement 102 and bounces, the finger members 108 prevent the contact button assembly 72 from retracting back down conducting tube 90. As can be seen, finger members 108 are adapted to allow the contact button assembly 72 to pass through the interior of catcher assembly 100 in one direction but not to allow the contact button assembly 72 to pass back through catcher assembly 100 in the opposite direction. This prevents striker pin 78 from allowing latch release tube 40 to return to its original position. If catcher assembly 100 were absent, it would be possible for the contact button assembly 72 to return some distance down tube 90 so that the latch release tube 40 could reset, thus permitting the now blown fuse to be re-latched back into the upper mounting 14. When striker pin 78 extends from the end of the fuse, the operated fuse cannot be re-latched back into the upper mounting 14. Accordingly it can be seen that the present invention provides a reliable means of assuring that the arcing rod and contact button assembly do not bounce or fall back to prevent the release of the fuse from the upper mounting, or allow the blown fuse to be reclosed into the circuit, or fail to indicate its blown condition.

It should be apparent to anyone skilled in the art that various changes, alteration, or modifications may be made in the present invention without departing from the spirit and scope of the present invention as defined in the appended claims.

I claim:

1. In a high voltage fuse of the type having an arcing rod moveable within the fuse under the urging of a spring to one end of the fuse when a fusible element melts so that an end of the arcing rod engages a fuse release assembly to cause the fuse to disengage a fuse mounting, an improvement comprising:

means for engaging the arcing rod only after it moves to the end of the fuse to prevent the arcing rod from moving back away from the end of the fuse, wherein the arcing rod includes a flange arranged to first pass, then be engaged by said finger.

2. In a fuse of the type having a spring-biased arcing rod moveable within and toward one end of the fuse in response to the melting of a fusible element, the arcing rod at the one fuse end engaging a fuse release assembly to cause the fuse to disengage from its fuse mounting, an improvement comprising:

(a) a flange on the arcing rod; and (b) means for (i) permitting free movement of the arcing rod toward the one fuse end, (ii) permitting free movement of the flange therethrough, and (iii) contacting the flange to prevent movement of the arcing rod away from the one fuse end only after the arcing rod has reached the one fuse end.

3. The fuse of claim 2 wherein the means comprises a finger extending inwardly of the fuse and directed toward the one fuse end, the finger being so positioned as to (a) not contact the arcing rod during its movement toward the one fuse end (b) flex outwardly during the movement of the flange therepast to permit continued free movement of the arcing rod, and (c) flex inwardly after the arcing rod reaches the one fuse end for engaging the flange to prevent further arcing rod movement.

* * * * *

UNITED STATES PATENT AND TRADEMARK OFFICE

CERTIFICATE OF CORRECTION

PATENT NO. : 4,344,059

DATED : August 10, 1982

INVENTOR(S) : R. T. Swanson

It is certified that error appears in the above—identified patent and that said Letters Patent is hereby corrected as shown below:

Claim 1, line 9 (column 4, line 68), after "fuse," insert -- and --;

, line 10 (column 5, line 1), cancel "wherein the arcing rod includes";

, same line after "flange" insert -- on the arcing rod --; and

, line 11 (column 5, line 2), cancel "finger" and insert -- engaging means --.

Signed and Sealed this

*Fifth* Day of *October 1982*

[SEAL]

*Attest:*

GERALD J. MOSSINGHOFF

*Attesting Officer*

*Commissioner of Patents and Trademarks*